United States Patent [19]

Fukushima

[11] Patent Number: 4,790,429

[45] Date of Patent: Dec. 13, 1988

[54] PACKAGE

[75] Inventor: Tadao Fukushima, Kawasaki, Japan

[73] Assignee: Dispen Pak Japan Co., Inc., Tokyo, Japan

[21] Appl. No.: 139,622

[22] Filed: Dec. 30, 1987

[30] Foreign Application Priority Data

Jan. 8, 1987 [JP] Japan ..... 62-627[U]

[51] Int. Cl.[4] ..... B65D 25/08

[52] U.S. Cl. ..... 206/219; 206/469

[58] Field of Search ..... 206/219, 221, 568, 469

[56] References Cited

U.S. PATENT DOCUMENTS 4,023,675 5/1977 Claasen ..... 206/219
4,130,245 12/1978 Bryson ..... 206/219
4,341,302 7/1982 Baker et al. ..... 206/568
4,402,402 9/1983 Pike ..... 206/221
4,608,043 8/1986 Larkin ..... 206/219
4,664,257 5/1987 Nilson ..... 206/219

*Primary Examiner*—Joseph Man-Fu Moy
*Attorney, Agent, or Firm*—Rosen, Dainow & Jacobs

[57] ABSTRACT

A package for storing one or more kinds of contents separately and dispensing the contents simultaneously, comprising a lid made of a stiff material with a bending line at the center, and a container member made of a flexible material fixed to the reverse of the lid, forming pockets on both sides of the bending line, in which each of the pockets has a communication portion communicating with one of different portions on the bending line but not communicating with another portion.

3 Claims, 2 Drawing Sheets

PACKAGE

BACKGROUND OF THE INVENTION

1. Field of the Invention

This invention relates to the structure of a small package for storing therein a liquid, paste-like, powdery or granular content such as seasonings and drinks, cosmetics, chemicals, and so forth. More particularly, the present invention relates to a package which stores at least one kind of content in its independent pockets and can dispense the contents simultaneously and easily by the pinching and rupturing the package by fingers of one hand without mixing the contents (such as vinegar and oil, coffee and cream, powdery detergents and powdery bleacher, and the like).

2. Description of the Conventional Art

Various small packages whose content can be taken out easily by a finger-pinching operation have been proposed in the past as typified by the packages of Japanese Patent Laid-Open Nos. 103,866/1984 and 104,973/1986. These packages have the structure in which the peripheral portion of a flexible container member is fixed to the reserve of a relatively stiff, flat and sheet-like lid to define a pocket, a content is sealed in the pocket, a bending line such as a perforation is formed on the axis at the center of the lid surface so as to make the lid easily bendable and a projection having a pyramidal shape or a shape of a circular truncated cone is formed at the center of the axis in order to easily dispense the content. In this structure, the content can be dispensed with directivity from a narrow zone such as the projection formed on the lid by pinching the package between the fingers and bending the lid in a V-shape in such a manner as to compress the pocket with the axis of the lid being the center.

However, in the conventional packages such as described above, the lower part of the pyramidal or circular truncated conical projection disposed at the center of the lid is used as a communication portion communicating with pockets on both sides. Accordingly, the contents can freely move between these pockets, and the package cannot be used when the contents must not mix with each other. Mixing of the contents before use deteriorates the appearance or reduces the quality of a product when, for example, two kinds of medicines (e.g. powdered medicine and liquid medicine for a patient or peanut butter and strawberry jam to be spread on bread, are sealed independently in the pockets.

SUMMARY OF THE INVENTION

The present invention is directed to the structure of a small package which can eliminate the problem of the conventional art described above, does not mix the different kinds of contents stored independently in the respective pockets before use and can dispense simultaneously these contents from separate discharge ports by a one-touch operation.

The package in accordance with the present invention is characterized in that it comprises a lid having a bending line at the center of its surface and made of a stiff material, and a container member fixed to the reverse of the lid around its peripheral portion, forming pockets on both sides of the bending line and made of a flexible material, each of the pockets having a communication portion communicating with one of different portions on the bending line of the lid but not communicating with another pocket.

DESCRIPTION OF THE PREFERRED EMBODIMENTS

Hereinafter, the present invention will be described with reference to its embodiments shown in the accompanying drawings.

Figure 1A:
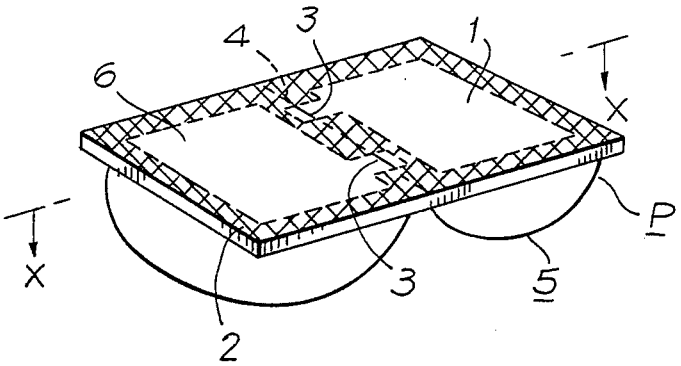
FIG. 1 shows one embodiment of the package in accordance with the present invention, wherein FIG. 1(*a*) is a perspective view, FIG. 1(*b*) is a sectional view taken along line X—X and FIG. 1(*c*) is a perspective view showing the state of its use.
Figure 1B:
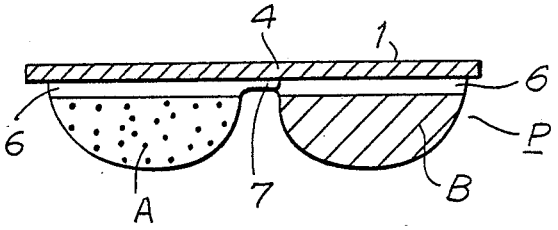
Figure 1C:
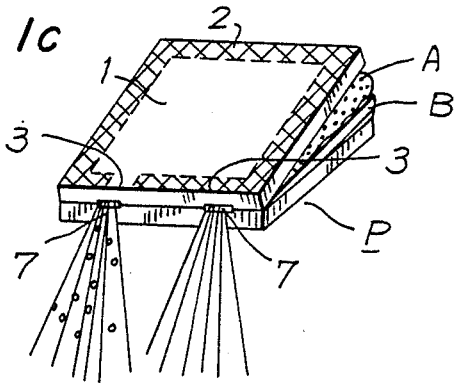
Figure 2A:
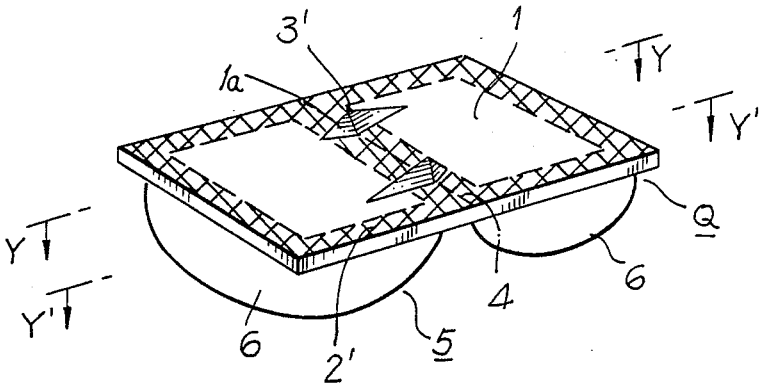
FIG. 2 shows another embodiment of the present invention, wherein FIG. 2(*a*) is a perspective view, FIG. 2(*b*) is a sectional view taken along line Y—Y, FIG. 2(*c*) is a sectional view taken along line Y'—Y' and FIG. 2(*d*) is a perspective view showing the state of its use.
Figure 2B:
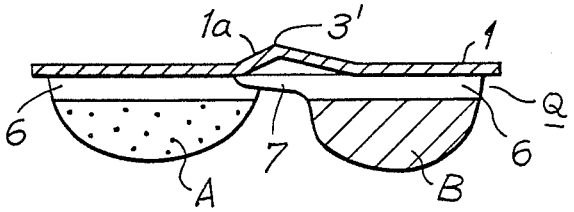
Figure 2C:
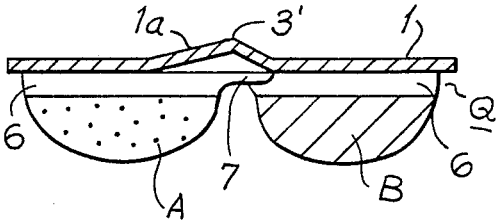
Figure 2D:
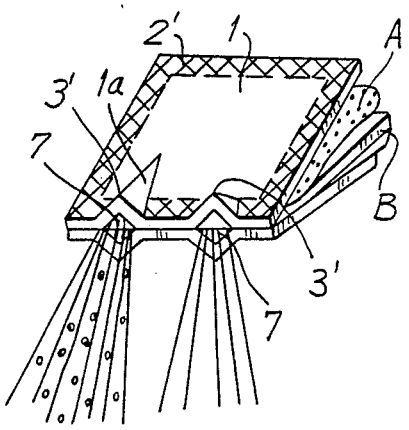

FIG. 1 shows one example (P) of thepackage in accordance with the present invention.

In the drawing, reference numeral 1 represents a flat sheet-like lid which is made of a bendable but stiff material such as a synthetic resin (e.g. polyethylene or polystryene copolymer) but does not have any projection or the like. A bending line 4 consisting of a perforation is formed along the axis at the center of the lid surface. Reference numeral 5 represents a container member whose peripheral portion is fixed to the reverse of the lid 1 and which consists of a flexible sheet member such as polyethylene or aluminum. the bottom of the container member 5 is recessed greatly in such a manner as to define two pockets 6, 6 having a substantially equal capacity with the bending line 4 of the lid 1 being the center, as shown in FIG. 1(*b*). The container member 5 has communication portions 7, which, formed when the pockets 6 are formed, communicate separately with those portions which are spaced apart from each other on the reverse of the bending line 4 (hereinafter the portions on the bending line 4 communicating with the communication portions 7 are referred to as "rupture zone" 3). In other words, the lid 1 and the pockets 6 are fixed along the bending line 4 so that rear sides of the rupture zones 3 are fixed alternately on both sides of the bending line 4 as the axis of symmetry and the peripheral portions of the rupture zones 3 are fixed except for the rupture zones 3 which are left unfixed, thereby forming a fixed zone 2. Paste-like different contents A and B are sealed into the pockets 6 of the package (P) having the structure described above by a suitable sealing method, respectively.

Before the package (P) having the structure described above is used, the contents A and B stored in the pockets 6 are sealed completely by the lid 1, the fixed peripheral zone of the container member 5 and its fixed portion along the bending line 4 and cannot therefore move freely between the pockets. When both sides of the lid 1 are pinched by fingers with the bending line 4 being the center and the lid 1 is bent in a V-shape in such a manner as to attract the pockets 6 to each other, the pockets 6 come into contact with each other and are compressed so that a large load is applied to the contents A, B and this internal pressure is as such applied straight to the rupture zones 3 on the bending line 4 consisting of a perforation or the like. Then, the rupture zones 3 are broken and the contents A, B simultaneously flow from the right and left pockets 6 through the respective communication portions 7 and the respective rupture zones 3 to the outside. In this instance, since the portions near both sides of the bending line other than the rupture zones 3 are fixed in the same way as the fixed zone 2 between the reverse of the lid 1 and the peripheral portion of the container member 5, they are not ruptured even when the internal pressure described above is applied thereto, and the internal pressure acts so as to concentrate upon the unfixed rupture zones 3. Incidentally, the rupture will more easily occur if, in order to facilitate opening, a notch or tongue is formed in advance in the rupture zones 3 on the surface of the lid 1 in addition to the perforation. Therefore, the contents A, B can be dispensed easily with directivity from the extremely narrow zone on the lid surface, that is, the rupture zones, 3, by a one-hand operation.

FIG. 2 shows another embodiment (Q) of the package in accordance with the present invention. FIG. 2(*a*) shows the appearance of the package, FIGS. 2(*b*) and 2(*c*) its internal structure and FIG. 2(*d*) shows the state of its use. In the drawing, reference numeral 1 represents a lid made of a bendable but stiff material (the specific example of which is the same as that of the package P of the foregoing embodiment; hereinafter the same), and a fixed zone 2' with the open peripheral portion of a container member 5 made of a flexible material (the specific example of the material of which is the same as that of the package P of the foregoing embodiment) is disposed on the reverse of this lid 1. The bottom of the container member 5 is recessed greatly in such a manner as to define two pockets 6 having a substantially equal capacity with a bending line 4 of the lid 1 being the center, as shown in FIGS. 2(*b*) and 2(*c*). Two pyramidal projections 1*a* are formed on the bending line of the lid 1 by recessing its reverse. The projections 1a cross the bending line 4 at two positions on the center axis of the lid 1 (not shown), and have tips 3' which are easily ruptured or opened when the lid 1 is bent along the bending line 4. Fixing of the pockets 6 inside the zones along the bending line 4 is the same as in the foregoing embodiment. Therefore, the pockets 6 have their respective communication portions 7 communicating with the lower portions of the respective projections 1*a*. Paste-like different contents A and B are sealed into the pockets 6 of the structure having the structure described above by a suitable sealing method.

Before the package (Q) having the structure described above is used, the contents A, B stored in the pockets 6 are sealed completely by the peripheral fixed zone 2' between the lid 1 and the container member 5 by the fixed portion of the container member 5 along the bending line 4 and cannot therefore move freely between the pockets. To dispense these contents A, B, the lid 1 is first pinched between ones fingers in such a manner that the tips 3' of the projections 1*a* of the lid 1 face downward. Then, when the lid 1 is bent along the bending line 4 in such a manner as to clamp the right and left pockets 6, both pockets 6, come into contact with each other and are compressed. Thus, a high load is exerted on the contents A, B and the internal pressure is applied as it is through the communication portions 7 to the tip portions 3' of the respective projections 1*a* on the bending line 4. As a result, rupture occurs on the lid 1 from the tip portions 3' s that the contents A, B are dispensed from the rupture portions, respectively. Therefore, with the package (Q), in the same way as the package (P), the contents A, B can be easily taken out with directivity from the extremely narrow zone of the lid surface, that is, the tips 3' by a one-hand operation.

As described in detail, the package in accordance with the present invention does not permit free movement of the contents stored in the respective pockets between them. Therefore, the present invention can prevent the mixture of the contents or non-uniform existence of the contents in either one of the pockets during storage and transportation of the package before its use. Therefore, the appearance of the package can be improved and different kinds of contents which, although to be used simultaneously, will otherwise cause degradation of quality upon mixture, can be sealed separately into the same package. Since the contents can be dispensed extremely easily by a one-touch operation, the package of the present invention can be used in various fields for dispensing drinks, cosmetics, chemicals, and so forth.

I claim:

1. A package comprising:

a lid made of a stiff material and having a bending line at the center of the surface thereof; and a container member made of a flexible material, fixed to the reverse of said lid around its peripheral portion and forming pockets on both sides of said bending line;

each of said pockets having a communication portion communicating with one of different portions on said bending line of said lid but not communicating with another portion.

2. A package as claimed in claim 1, wherein portions on said bending line of said lid communicating with said communication portions of said container member are structured so as to be opened by bending said lid.

3. A package as claimed in claim 1, wherein portions of said lid communicating with said communication portions of said container member are formed as pyramidal or circular truncated conical projections.

* * * * *

REEXAMINATION CERTIFICATE (1521st)

United States Patent [19]

Fukushima

[11] B1 4,790,429

[45] Certificate Issued Jul. 30, 1991

[54] PACKAGE

[75] Inventor: Tadao Fukushima, Kawasaki, Japan

[73] Assignee: Dispen Pak Japan Co., Inc., Tokyo, Japan

Reexamination Request:
No. 90/001,890, Nov. 20, 1989

Reexamination Certificate for:

| | |
|---|---|
| Patent No.: | **4,790,429** |
| Issued: | **Dec. 13, 1988** |
| Appl. No.: | **139,622** |
| Filed: | **Dec. 30, 1987** |

[30] Foreign Application Priority Data

Jan. 8, 1987 [JP] Japan ..... 62-627

[51] Int. Cl.[5] ..... B65D 25/08
[52] U.S. Cl. ..... 206/219; 206/469
[58] Field of Search ..... 222/94, 541, 207; 206/634, 469, 219

[56] References Cited

U.S. PATENT DOCUMENTS

| | | |
|---|---|---|
| 3,986,640 | 10/1976 | Redmond . |
| 4,023,675 | 5/1977 | Claasen . |
| 4,130,245 | 12/1978 | Bryson . |
| 4,236,652 | 12/1980 | Beguhn . |
| 4,341,302 | 7/1982 | Baker et al. . |
| 4,402,402 | 9/1983 | Pike . |
| 4,493,574 | 1/1985 | Redmond et al. . |
| 4,608,043 | 8/1986 | Larkin . |
| 4,611,715 | 9/1986 | Redmond . |
| 4,664,257 | 5/1987 | Nilson . |
| 4,724,982 | 2/1988 | Redmond . |

FOREIGN PATENT DOCUMENTS

| | | |
|---|---|---|
| 2161453 | 7/1973 | France . |
| 103866 | 11/1983 | Japan . |
| 104973 | 5/1986 | Japan . |

*Primary Examiner*—Joseph M. Moy

[57] ABSTRACT

A package for storing one or more kinds of contents separately and dispensing the contents simultaneously, comprising a lid made of a stiff material with a bending line at the center, and a container member made of a flexible material fixed to the reverse of the lid, forming pockets on both sides of the bending line, in which each of the pockets has a communication portion communicating with one of different portions on the bending line but not communicating with another portion.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 are cancelled.

New claims 4, 5, 6 and 7 are added and determined to be patentable.

*4. A package comprising:*

*a lid made of a stiff material and having a bending line at the center of the surface thereof; and*

*a container member made of a flexible material, fixed to the reverse of said lid around its peripheral portion and forming a first pocket on one side of said bending line and a second pocket on the other side of said bending line;*

*each of said first and second pockets having a respective communication portion which communicates with a different portion on said bending line of said lid;*

*said communication portion of said first pocket not communicating with any portion of said second pocket and said communication portion of said second pocket not communicating with any portion of said first pocket, whereby said first and second pockets are isolated from each other;*

*said first and second pockets being both located on a common axis in the plane of said lid and said axis being normal to said bending line.*

*5. A package as claimed in claim 4 wherein portions of said lid communicating with said communication portions of said container member are formed as projections.*

*6. A package as claimed in claim 5 wherein said projections are asymmetrically disposed with respect to said bending line.*

*7. A package as claimed in claim 5 wherein said projections are of pyramidal or circular truncated conical shape.*

* * * * *